United States Patent [19]

Nezworski

[11] 4,351,456

[45] Sep. 28, 1982

[54] VALVED KEG CLOSURE

[75] Inventor: James E. Nezworski, Waukesha, Wis.

[73] Assignee: The Perlick Company, Inc., Milwaukee, Wis.

[21] Appl. No.: 196,645

[22] Filed: Oct. 14, 1980

[51] Int. Cl.[3] ..... B67D 1/04

[52] U.S. Cl. ..... 222/400.7; 137/212

[58] Field of Search ..... 137/212, 320, 322; 222/400.7, 400.8, 402.19, 402.25, 402.24

[56] References Cited

U.S. PATENT DOCUMENTS

| | | | |
|---|---|---|---|
| 3,610,478 | 10/1971 | Johnston | 137/212 |
| 4,089,444 | 5/1978 | Shea | 137/212 |
| 4,133,461 | 1/1979 | Vercelot | 222/402.24 |
| 4,142,658 | 3/1979 | Golding . | |
| 4,150,771 | 4/1979 | Golding . | |
| 4,181,143 | 1/1980 | Fallon . | |

FOREIGN PATENT DOCUMENTS

| | | | |
|---|---|---|---|
| 384480 | 2/1932 | United Kingdom | 222/501 |

*Primary Examiner*—Stanley H. Tollberg

*Attorney, Agent, or Firm*—James E. Nilles; James R. Custin

[57] ABSTRACT

A valved keg closure unit is secured in a keg bushing by means of an axially shallow, externally threaded annular collar, received in an internally threaded upper portion of the bushing and overlying an upper cylindrical element of the closure unit that comprises a coaxial annular valve seat. The collar bottoms on an upwardly facing circumferential shoulder in the bushing to prevent excessive axial compression of a resilient sealing ring between the cylindrical element and the bushing. To prevent rotation of the cylindrical element, it has circumferentially spaced, radially outwardly projecting tits, received in axially extending internal grooves in the bushing. A downwardly projecting annular wall portion of the cylindrical element, having a circumferential internal groove, surrounds the top portion of a fixed tubular element, which has a radially outwardly rolled circumferential land received in said groove to permanently connect those elements. An axially movable siphon tube, having an annular valve element at its top that is engageable with said valve seat, is restrained against skewing by integral inwardly struck fingers on the tubular element.

9 Claims, 7 Drawing Figures

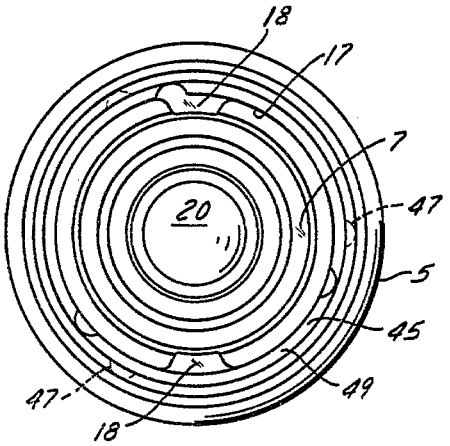
FIG. 4
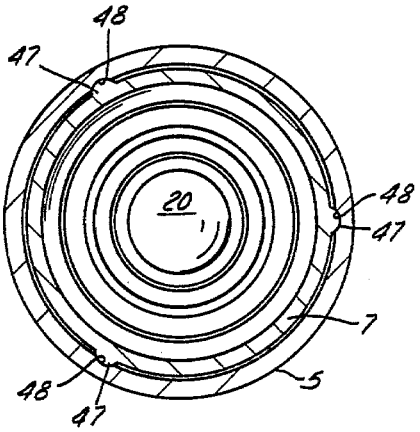
FIG. 5
FIG. 6
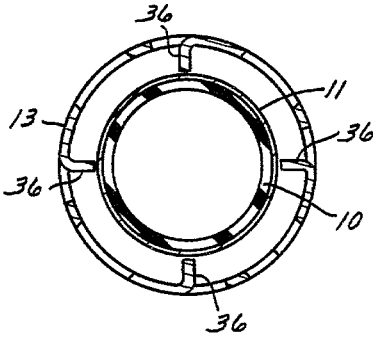
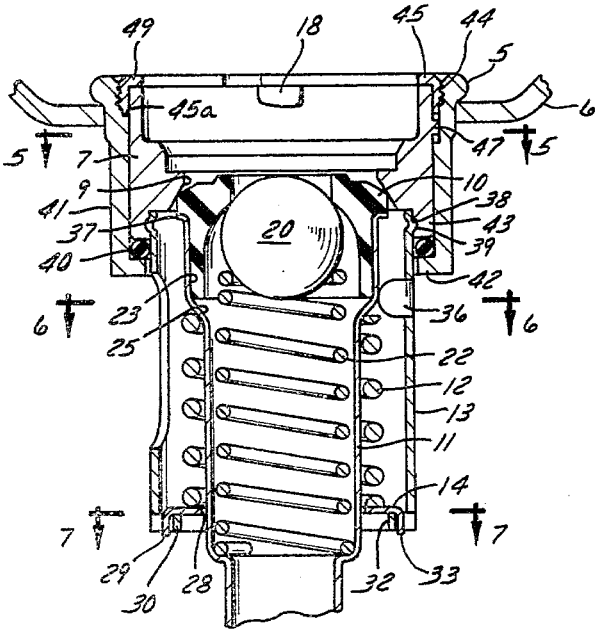
FIG. 3
FIG. 7
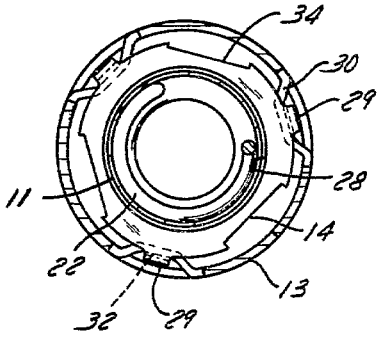

VALVED KEG CLOSURE

FIELD OF THE INVENTION

This invention relates to valved keg closures and is more particularly concerned with improvements in a keg closure of the type that is removably installed in a keg and has normally closed valves that can be opened by means of a tapping unit or coupler assembly which is readily detachably connectable to the keg closure.

BACKGROUND OF THE INVENTION

The recent state of the art relating to valved keg closures is exemplified by U.S. Pat. No. 4,181,143 to M. R. Fallon and U.S. Pat. Nos. 4,142,658 and 4,150,771, both issued to C. G. Golding.

A keg intended to be equipped with a closure unit of the general type to which this invention relates has an opening in its top wall in which a bushing is permanently installed. An upper portion of the closure unit, in the form of a cylindrical element, is removably seated in the bushing and defines an upwardly opening well with a coaxial annular valve seat at its bottom. The well accommodates the bottom portion of a tapping coupler that can be readily detachably connected to the closure unit, and for such connection there are bayonet lugs on the top of the cylindrical element that project radially into the well.

The closure unit also comprises an elongated siphon tube which has a bottom end near the bottom of the keg and which is axially movable to carry a valve element at its top into and out of engagement with the valve seat in the cylindrical element. The siphon tube is biased upward, to urge the valve element towards its closed position, by means of a coiled compression spring that surrounds it near its upper end but in downwardly spaced relation to the valve element. The spring is in turn surrounded by a relatively stationary tubular element, substantially shorter than the siphon tube but of substantially larger diameter, which is coaxially fixed to the cylindrical element and projects down from it. Near its lower end this tubular element supports an annular spring seat against which the lower end of the spring is engaged and through which the siphon tube extends for guidance in its axial motion.

The bushing that is fixed in the keg has a radially inwardly projecting annular flange at its bottom, which underlies the cylindrical element of the closure unit and through which the stationary tubular element projects downward. Between this flange and the underside of the cylindrical element, closely surrounding the tubular element, there is a resilient sealing ring, and the cylindrical element is normally secured in the bushing in such a manner as to be under downward force whereby the sealing ring is axially compressed to provide a seal between the bushing and the closure unit.

Practically all commercial beer kegs are equipped with valved closures of this general character, in one form or another. Although such commercial success attests to a well developed state of the art, there is a pressing need and desire to achieve further improvements, because the industry concerned with the manufacture of keg closures is a vigorously competitive one that relies upon skill and ingenuity for the attainment of commercial advantage. The principal purchasers of keg closure units are breweries, which buy them in large quantities and on the basis of careful comparison of both cost and technical features. Thus, even a small difference in unit cost as between competitive closure units may have substantial commercial significance. Considering that the above identified patents were assigned to active manufacturers of closure units, and that they disclose devices now being successfully marketed, it will be apparent that those patents represent the farthest advance to date that has been attainable by skill in the art coupled with inventive ingenuity.

Although it is imperative that a satisfactory keg closure be inexpensive, low cost cannot be attained at the sacrifice of other essentials, including great sturdiness for resistance to extremely rough handling, complete reliability in the face of abusive treatment, and an inherent capability for being thoroughly and easily cleaned.

An overriding requirement is that the closure be safely removably from a keg in which it is installed. A valved closure normally remains in a keg through numerous trips to and from the brewery, as well as during the wash that precedes every fill, but it must be readily removable from the keg for repair or replacement. Because its removal could occur at a time when the keg is pressurized—and possibly even highly pressurized—the closure assembly must be secured in the keg in such a manner as to provide for a gas-tight seal between it and the keg and also provide for a removal procedure wherein the seal is opened to permit escape of substantially all pressure gas while the closure assembly continues to be restrained against separation from the keg, so that the assembly is released only after there is no danger of its being blown out.

The above identified Golding patents disclose assemblies wherein the upper cylindrical element of the closure unit has a direct threaded connection with the bushing that is fixed in the keg, so that the resilient sealing ring confined between the bushing and the cylindrical element is axially compressed by screwing the closure unit into the bushing. Such an arrangement is safe because the seal is opened for escape of gas from the keg before the cylindrical element is completely screwed out of the bushing. However, it is possible for the closure unit to be screwed so deeply into the keg bushing as to over-compress the resilient sealing ring, subjecting it to "compression set" that causes it to lose its sealing capability. Another important disadvantage of a direct threaded connection between the closure unit and the keg bushing is that torque imposed upon the closure unit when a tapping coupler is being disconnected from it can loosen the closure unit in the bushing, especially if the resilient sealing ring has become embrittled or taken a set, and thereupon the closure unit can come out of the keg with the tapping coupler.

The above identified Fallon patent discloses an arrangement that was intended to avoid overcompression of the sealing ring without sacrifice of safety and whereby the closure unit was confined against rotation under torque imposed upon it through the coupler. The cylindrical upper element of the closure unit had radially outwardly projecting lugs that were receivable in short axially extending upper keyway slots in the keg bushing, opening upwardly to its top edge and downwardly into a circumferential groove. When the cylindrical element had been inserted partway down into the bushing, its lugs engaged the bottom surface of the circumferential groove, and it then had to be rotated a fractional turn to bring its lugs into register with lower keyway slots that opened upwardly into said groove and extended a limited distance down from it. With its lugs bottomed in the lower keyway slots, the cylindrical element was in an axial position in which it subjected the resilient sealing ring to a desired amount of compression. The cylindrical element could be confined in that position by a radially expansible retainer ring overlying its top edge and received in the circumferential groove. Upon removal of the retainer ring, the cylindrical element could rise far enough for its lugs to engage the top surface of the circumferential groove, permitting escape of gas, but it could not be removed from the bushing until it had been rotated to align its lugs with the upper keyway slots. One evident disadvantage of this arrangement was that the groove and keyway slots in the bushing were somewhat difficult and expensive to machine. Furthermore, special equipment was needed for forcing the closure unit down against the resilience of the sealing ring so that the expansible retainer ring could be inserted into the circumferential groove.

In the earlier closure assemblies, the siphon tube had little guidance that confined it to purely axial motion, and consequently the valve on the top of that tube could be cocked or skewed out of coaxial relation to its seat if it was forced open by a probe or the like that acted at an inclination to its axis. Such skewing of the valve element could occur if the keg was tilted when in place on a washing or filling rack, as sometimes happened when the keg had been deformed by rough handling. In such cases, owing to the lack of guidance for the siphon tube, the valve element could maintain its skewed attitude as it re-engaged its seat on the cylindrical upper element of the closure, with the result that the closure leaked.

The Golding patents disclose a washer-like or spider-like guide element surrounding the upper portion of the siphon tube member, just below the valve element thereon, to provide a seat for the upper end of the compression spring that biases that tube member upwardly. Radially outer edge portions of this guide element slidingly engage the fixed tubular element surrounding the siphon tube member, cooperating with that tubular element to confine the siphon tube member to axial motion and restrain it against cocking and skewing. Although this spider-like part serves in the dual role of spring seat and guide element, the present invention reveals that both of these functions can be very satisfactorily performed without the need for a separate part, thus eliminating the cost of manufacturing and installing it.

The Golding patents focus upon means for providing a connection and seal between the upper cylindrical element of the closure assembly and the upper end of the tubular element that projects down into the keg from that cylindrical element. That connection must be a sturdy one because forces imposed upon the tubular element by the valve springs are transferred to the cylindrical element through it. Again, it has become apparent from the present invention that the expedients devised by Golding left something to be desired with respect to low cost and manufacturing simplicity.

SUMMARY OF THE INVENTION

In general, the object of the present invention is to provide a valved keg closure of the character described that is lower in cost than the closure assemblies typified by the above identified patents but is nevertheless at least as satisfactory as those assemblies with respect to reliability, sanitation, sturdiness and safety. Having in mind that the keg closures of those prior patents were devised by persons who had a high degree of skill and a remarkable ingenuity in the art—as attested by patents issued to them—it will be apparent that it has not heretofore been obvious to persons of ordinary skill in the art how the objectives of the present invention could be attained.

One specific object of this invention is to provide a keg closure of the character described wherein the fixed tubular element has a very rigid, sturdy and compact attachment to the upper cylindrical element, obtainable at very lost cost with inexpensive and readily-available facilities and requiring no special treatment or expedient for the provision of a seal between the connected elements.

Another specific object of the invention is to provide a valved keg closure assembly of the type comprising an upper cylindrical element that is received in a keg bushing, and wherein there is a resilient, axially compressible sealing ring confined between the cylindrical element and the bushing, said assembly having very simple and inexpensive means for limiting the amount of axial compression applied to said sealing ring and for releasing the seal at said sealing ring to provide for escape of gas from the keg while still confining the cylindrical element against complete separation from the bushing, to restrain the closure unit against being blown out of the keg.

In relation to the last-stated object of this invention, it is noteworthy that the Fallon patent emphasizes the desirability of a non-threaded retaining member for securing the closure assembly in a keg bushing, whereas the present invention turns away from that teaching and employs a threaded retaining member, to enable the closure assembly of this invention to be installed in a keg without need for special provisions for forcing it down to its sealing position before insertion of a retaining member into the keg bushing; but the present invention nevertheless affords assurance that a resilient sealing ring confined between the closure assembly and the bushing will be subjected to no more than a predetermined degree of compression.

Notwithstanding the employment of a threaded retaining member, the present invention has as another of its objects the provision of a keg closure assembly of the character described that cannot be rotated in the keg by torque applied through a tapping coupler being connected to it or disconnected from it.

A further specific object of the present invention is to provide a keg closure of the character described, having the conventional radially inwardly projecting lugs on its top that provide for connection of a tavern unit or coupler assembly to it, wherein those lugs are substantially reinforced by a collar that serves to retain the closure assembly in a keg bushing and also serves to compress a resilient sealing ring that is confined between the keg assembly and the bushing.

It is also an object of this invention to provide a keg closure having an elongated, axially movable siphon tube, the top of which comprises a valve element, wherein that siphon tube is biased upward by means of a coiled compression spring which surrounds it, and wherein the downward reaction of that spring is taken by a very simple and inexpensive spring seat member that also cooperates with the siphon tube to confine it to axial motion, said spring seat being arranged to have a very sturdy and secure connection with a relatively fixed element of the closure notwithstanding that its connection with that fixed element enables it to be quickly and easily installed and removed.

These objects of the invention are achieved in a valved keg closure that is generally conventional in comprising a relatively fixed substantially cylindrical element which is securable in a keg wall aperture and which defines a coaxial annular valve seat, a relatively fixed tubular element coaxially secured at a top end portion thereof to said cylindrical element and projecting downward from it, and an axially movable tube member coaxially received in said tubular element with substantial radial clearance and having an upper end at which there is a valve element, said tube member being substantially longer than said tubular element to have its lower end near the bottom of a keg in which the closure is installed and being biased upward for normal engagement of said valve element with said valve seat. In the keg closure of the present invention, a portion of said tube member that is surrounded by the fixed tubular element is of substantially uniform diameter along its length, and the tubular element has circumferentially spaced, radially inwardly projecting lugs fixed thereon, intermediate its top and bottom ends, slidingly engaging said portion of the tube member to confine the same to axial up and down motion. Preferably these lugs comprise radially inwardly bent tabs that are integral with the tubular element.

Another characterizing feature of the keg closure of this invention is that its cylindrical element has a downwardly projecting side wall portion in which the top end portion of the tubular element is received, and it has in said side wall portion a radially inwardly opening circumferential groove; and the top end portion of the tubular element is radially outwardly deformed to comprise a circumferential land that is received in said groove to securely connect the tubular element to the cylindrical element.

A further characterizing feature is that the tubular element has near its bottom end a plurality of integral, circumferentially spaced, radially inwardly projecting abutment portions, each of which provides an upwardly facing abutment; and there is a substantially flat spring seat member having a top surface against which said spring reacts downwardly, a central hole in which the tube member is received with a substantially close sliding fit, and circumferentially spaced edgewise projecting supporting portions which overlie said abutments in one position of edgewise rotation of the spring seat member and which define between them recesses that enable the spring seat member to pass said abutment portions as it is axially upwardly inserted into said tubular element in another position of edgewise rotation.

A keg closure assembly of the type to which this invention relates is adapted to have its cylindrical element removably received in a keg bushing element that is secured in a keg wall aperture and has an upwardly extending annular side wall and a radially inwardly projecting annular flange on the bottom of said side wall, and the keg closure has a resilient sealing ring for axial compression between said flange and its cylindrical element to provide a seal between the bushing element and the closure unit. In the keg closure assembly of this invention, the bushing element has an internal thread in the upper portion of its side wall, to provide for releasable securement of the cylindrical element in the bushing element; and an annular collar that is coaxially receivable in said upper portion of the bushing element side wall, in overlying relation to the cylindrical element, has an external thread for cooperation with said internal thread to enable the coller to be screwed into the bushing element to impose downward force upon the cylindrical element. The annular collar and the bushing element have opposed surfaces respectively facing in opposite substantially axial directions that are engageable to define a limit of downward motion of the collar relative to the bushing element, at which the resilient ring is under a predetermined axial compression. Preferably the cylindrical element has circumferentially spaced radially outwardly projecting tits which are received in circumferentially spaced axially extending grooves in the bushing element to prevent rotation of the cylindrical element. It is also preferred that said upper portion of the bushing element side wall, which has said internal thread, have a larger inside diameter than the lower portion thereof, to define an upwardly facing circumferential shoulder therein that provides one of said opposite surfaces; and that the collar have at its top a radially inwardly projecting annular flange which overlies the top of the cylindrical element, adjacent to bayonet lugs thereon, and which supports the bayonet lugs against upward deformation.

BRIEF DESCRIPTION OF DRAWINGS

In the accompanying drawings, which illustrate what is now regarded as a preferred embodiment of the invention:

FIG. 3 is a view generally similar to FIG. 1 but showing the keg closure with no tapping coupler thereon and with its valves in their normally closed condition;

FIG. 4 is a top view of the keg closure in the condition in which it is shown in FIG. 3;

FIG. 5 is a view in cross-section, taken on the plane of the line 5—5 in FIG. 3;

FIG. 6 is a view in cross-section, taken on the plane of the line 6—6 in FIG. 3; and FIG. 7 is a view in cross-section, taken on the plane of the line 7—7 in FIG. 3.

DETAILED DESCRIPTION OF PREFERRED EMBODIMENT OF THE INVENTION

Figure 1:
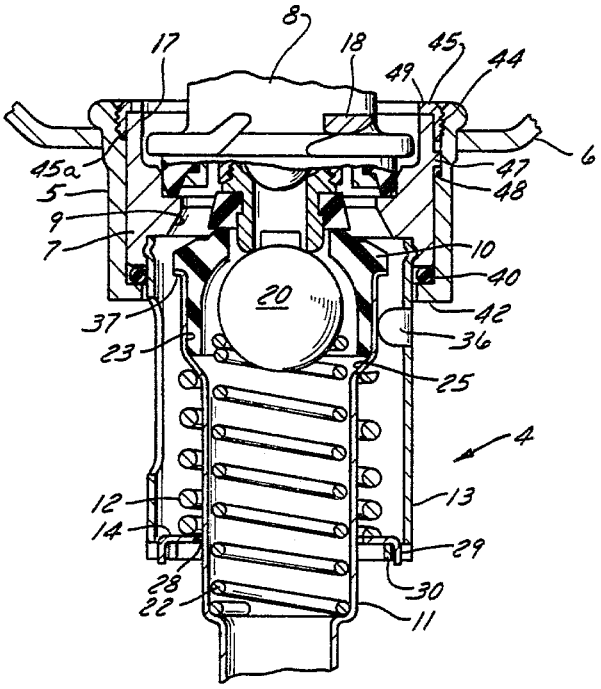
FIG. 1 is a view substantially in vertical section of a valved keg closure assembly of this invention with a tapping coupler attached to it and holding its valves open, only the lower portion of the tapping coupler being shown.
Figure 2:
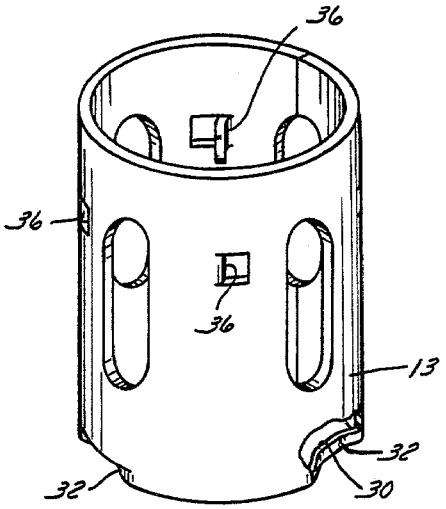
FIG. 2 is a perspective view on a somewhat enlarged scale, showing the tubular element of the keg closure of this invention before its assembly into the cylindrical upper element.

To accommodate a valved closure unit 4 of this invention, a keg in which it is to be installed has an annular bushing 5 welded into a closely fitting hole in its top wall 6. The closure unit 4 comprises a relatively stationary upper cylindrical element 7 that is removably receivable in the bushing 5. An upwardly opening coaxial well 17 in the cylindrical element 7 receives the bottom portion of a tapping coupler 8 that is detachably connectable to the closure unit 4, and at the bottom of that well the cylindrical element defines a concentric annular valve seat 9. An annular valve element 10 that is cooperable with the valve seat 9 comprises a top end portion of an elongated axially movable siphon tube member 11 that projects far enough down into the keg to have its bottom end (not shown) near the bottom of the keg.

To maintain the valve element 10 normally engaged against its seat 9, the siphon tube member 11 is biased upward by a helical compression spring 12 that surrounds it. The downward reaction force of the spring 12 is taken by a relatively stationary tubular element 13 that surrounds the spring and has its upper end portion coaxially secured to the cylindrical element 7. The tubular element 13 projects down into the keg a substantially smaller distance than the siphon tube member 11, and near its bottom it supports a spring seat member 14 against which the bottom end of the spring 12 is engaged.

In the keg closure unit here illustrated, the valve element 10 on the top of the siphon tube member 11 is annular, and in addition to serving as a gas valve in its cooperation with the relatively stationary annular valve seat 9, it comprises a seat for a concentric liquid valve 20 that is housed within the siphon tube member 11. The liquid valve 20, here shown as a ball, is biased upward, for normal engagement with the annular valve element 10, by means of a concentric helical spring 22 that is also inside the siphon tube member 11.

When a tapping coupler 8 is connected with the closure unit 4 and is placed in an operative condition, as shown in FIG. 1, the valves 10 and 20 of the closure unit are held open by the tapping coupler. Pressure gas can then flow into the keg from the tapping coupler, around the exterior of the siphon tube member 11, and the pressure of such gas forces liquid up through the siphon tube member, past the open liquid valve 20, and into the tapping coupler.

To provide for the conventional bayonet connection between the closure unit 4 and a tapping coupler 8, the upper cylindrical element 7 of the closure unit has at its top a pair of diametrically opposite bayonet lugs 18 that project radially into the upwardly opening well 17 in it.

In the closure unit 4 here illustrated, the annular valve element 10 that comprises the gas valve is made of rubber or the like and has substantial axial depth. It is telescoped into a portion 23 of the siphon tube member 11 that is near its upper end and has a uniform diameter along its length. Beneath this portion 23 the tube member 11 has a smaller diameter portion which is surrounded by the helical spring 12 that imposes upward bias upon it. An abrupt change in diameter of the tube member 11 between these two portions of it defines a downwardly facing circumferential shoulder 25 on its exterior that provides a seat for the upper end of the spring 12. Farther down, at a portion of the siphon tube member 11 that is normally below the bottom of the tubular element 13, it has another abrupt reduction in diameter, defining an internal circumferential shoulder 26 that serves as a seat for the bottom end of the liquid valve spring 22.

The spring seat member 14 that supports the bottom end of the external spring 12 can be made as a very inexpensive stamping. For the most part it is flat, with a central hole 28 through which the siphon tube member 11 extends with a slidable fit, and with edgewise outwardly projecting supporting portions 29 that rest on upwardly facing abutments 30 formed on the fixed tubular element 13. To provide the abutments 30, the tubular element 13 has circumferentially spaced and circumferentially extending slits near its lower edge, cooperating with its lower edge to define circumferentially elongated strip-like portions 32, each of which is bowed along its length to be offset radially inwardly in relation to the rest of the tubular element 13. To confine the spring seat member 14 against edgewise displacement, both radially and rotationally, it has a claw-like downwardly projecting lug 33 on the outer end of each of its supporting portions 29, engaged over the radially outer surface of the underlying strip-like abutment portion 32.

The edgewise projecting supporting portions 29 of the spring seat member 14 define between them recesses or bays 34 that can clear the inwardly bowed abutment portions 32 as the spring seat member, in one position of its rotation, is inserted axially upwardly into the tubular element 13; and thereafter a small rotation of the spring seat member can bring it to its position in which its supporting portions 29 and their lugs 33 can engage the strip-like abutment portions 32. The force of the spring 12 holds the spring seat member 14 securely in place, but it is readily removable by lifting it against spring force and rotating it slightly to permit its supporting portions 29 to pass the abutment portions 32 of the tubular element 13.

To cooperate with the spring seat member 14 in confining the siphon tube member 11 to substantially axial motion, circumferentially spaced, integral tabs or fingers 36 are struck radially inwardly from the tubular element 13, at locations to have sliding engagement at their inner ends with the uniform diameter upper portion 23 of the tube member 11. The fingers 36 can extend radially inwardly through such distances that there is a small clearance between each of them and the siphon tube member 11 when the latter is accurately coaxial to the tubular element 13, because, to be effective, they need only prevent substantial skewing of the tube member 11.

The tube member 11 proper has at its upper end a small outwardly flared lip 37, and the resilient valve element 10, which projects above the upper end of the tube member 11, has a circumferential, radially narrow shoulder which overlies this flared lip for transmission of axial forces to the tube member 11 proper. In assembly of the closure unit 4, the valve element 10, separated from the tube member 11, can readily pass the tabs or fingers 36 when its axis is about at right angles to that of the fixed tubular element 13. Once it is above the fingers 36, it can be turned and brought to its operative position, coaxial with the valve seat 9 and engaged with the same. The tube member 11, with the liquid valve element 20 and its spring 22 in place therein, can then be moved up into the tubular element 9 and into telescoped relationship with the annular valve element 10. During such upward insertion of the tube member 11 into the tubular element 13, the outer spring 12 and its seat member 14 are not in place, and therefore the tube member 12 can be skewed to a substantial extent so that its flared lip 37 can pass the fingers 36. With the tube member 11 in place, the spring 12 and spring seat 14 are installed to complete the assembly. Disassembly is readily accomplished in a manner that will be obvious from the foregoing description.

The fixed tubular element 13 that supports the spring seat 14 must be rigidly and securely fixed to the cylindrical element 7, to transfer to the latter the downward reaction forces of the springs 12 and 22. For such connection, the cylindrical element 7 has an annular wall portion 43 that projects below the level of the valve seat 9 therein and surrounds the upper portion of the tubular element 13 with a fit which is fairly close but which need not be a drive fit. Axial separation of the elements 7 and 13 is prevented by a radially inwardly opening circumferential groove 38 in that side wall portion 43, in cooperation with a circumferential land 39 on the tubular element 13, engaged in said groove 38. The land 39, which is rolled into the tubular element 13 after it has been inserted into the cylindrical element 7, can be formed quickly and easily as a bulging deformation of the tubular element 13 that permanently locks it to the cylindrical element 7.

There may be a tiny space or crevice between the cylindrical element 7 and the tubular element 13, due to a clearance fit between those elements, and if desired that space can be filled with an anaerobic sealing compound. Such filling is not needed, however, because that space is sealed off by a resilient O-ring 40 that closely surrounds the tubular element 13 and underlies the lower edge of the cylindrical element side wall 43. The O-ring 40 has the further and very important function of providing a seal between the keg bushing 5 and the closure unit 4. When the closure unit 4 is installed in a keg, the O-ring 40 is confined under axial compression between the bottom of the cylindrical element 7 and a radially inwardly projecting circumferential flange 42 on the bottom of the keg bushing 5.

The cylindrical wall 41 of the keg bushing 5 has in its upper portion a somewhat enlarged inside diameter or counterbore 44 which is internally threaded to receive an axially short, externally threaded collar 45. At its top the annular collar 45 has a radially inwardly projecting circumferential flange 49 that overlies the cylindrical upper element 7 of the closure assembly to confine that cylindrical element in the bushing. When the collar 45 is screwed into the threaded portion 44 of the bushing 5, it forces the cylindrical element 7 down into compressive engagement with the resilient O-ring 40, effecting a good seal between the keg bushing and the relatively fixed elements 7 and 13 of the closure assembly. However, the O-ring 40 cannot be overcompressed because the internally threaded counterbore 44 in the keg bushing 5 defines an upwardly facing circumferential shoulder **45*a* upon which the bottom of the collar 45 seats when it is screwed into the bushing to such an extent that the cylindrical element 7 subjects the O-ring 40** to a desired compression.

To prevent rotation of the closure assembly under torque applied to it through the bayonet lugs 18 during installation or removal of a tapping coupler, there are circumferentially spaced, radially outwardly projecting lugs or tits 47 on the cylindrical element 7, received in radially inwardly opening grooves 48 in the side wall of the keg bushing 5 that extend downward from the internally threaded counterbore 44.

It will be evident that as the collar 45 is unscrewed for removal of the closure unit 4, compression of the O-ring 40 is relieved to permit escape of pressure gas from the keg through the clearance between the keg bushing 5 and the cylindrical element 7. Such pressure gas can raise the cylindrical element 7 in the bushing 5, but a few turns of the thread on the collar 45 will still have a connection with threads in the bushing after pressure in the keg is substantially relieved, and the collar 45 will thus prevent the closure unit 4 from being blown out of the keg. Thereafter, continued rotation of the collar 45 to completely unscrew it from the bushing 5 will release the closure unit 4 to be lifted out of the keg.

The bayonet connection lugs 18 on the cylindrical element 7 are sometimes subjected to very large forces that tend to bend them upwards, inasmuch as considerable leverage can be exerted through a tapping coupler 8, which projects up a substantial distance above the closure unit 4. Once these lugs 18 are bent or deformed, a tapping coupler cannot be installed with a good seal to the closure unit 4, and the closure unit has to be replaced. In the keg closure assembly of the present invention, the radially inwardly projecting circumferential flange 49 on the top of the annular collar 45, which overlies the upper edge of the cylindrical element 7, affords substantial reinforcement to the lugs 18 to prevent them from being bent upward. Said flange 49 has small radially inwardly opening notches at circumferentially spaced intervals, for receiving prongs or tangs on an inexpensive, generally conventional spanner (not shown), which is the only equipment needed for installation and removal of the keg closure unit.

From the foregoing description taken with the accompanying drawings it will be apparent that this invention provides a valved keg closure unit for cooperation with a generally conventional tapping coupler, wherein a resilient sealing ring confined between the closure and a keg bushing is normally maintained under no more than a predetermined axial compression, notwithstanding that there is a threaded connection between the bushing and a retaining member that secures the closure unit in the keg. The threaded retaining member ensures safety in removal of the closure unit from a highly pressurized keg, and, although very low in cost, has the further important advantage of providing reinforcement for the bayonet lugs by which a tapping coupler is attached to the closure unit. It will also be apparent that the keg closure of this invention has simple and very effective but inexpensive means for substantially confining its siphon tube member to axial motion, requiring no separate part for assuring that its gas valve will always move squarely to a closed position in which it makes a good seal with its seat.

What is being claimed is:

1. A keg closure for cooperation with a removable tapping coupler, comprising a relatively fixed substantially cylindrical element which is securable in a keg wall aperture and which defines a coaxial annular valve seat, a relatively fixed tubular element coaxially secured at a top end portion thereof to said cylindrical element and projecting downward therefrom, and an axially movable tube member coaxially received in said tubular element with substantial radial clearance and having an upper end at which there is a valve element, said tube member being substantially longer than said tubular element to have its lower end near the bottom of a keg in which the closure is installed and being biased upward for normal engagement of said valve element with said valve seat, said keg closure being characterized by:

A. a portion of said tube member that is surrounded by said tubular element being of substantially uniform diameter along its length; and B. said tubular element having integral, circumferentially spaced, radially inwardly bent tabs intermediate its top and bottom ends that slidingly engage said portion of the tube member to confine the same to axial up and down motion.

2. A keg closure having an elongated axially movable tube member with a valve element at an upper end thereof, a helical compression spring surrounding said tube member and acting upon it to bias it upward for engagement of said valve element against an annular valve seat, and a relatively fixed tubular element surrounding said spring in coaxial relation to said tube member and having a bottom edge spaced below a bottom end of said spring, said keg closure being characterized by:

A. a substantially flat spring seat member having (1) a central hole through which said tube member slidably extends, (2) a top surface which is engaged by said bottom end of said spring and substantially all portions of which lie in a common plane (3) edgewise radially projecting supporting portions between which the spring seat member has bays, and (4) a downwardly projecting lug on the radially outer end of each of said supporting portions; and B. said tubular element having circumferentially spaced apart and circumferentially elongated strip-like abutment portions adjacent to its lower edge, one for each supporting portion, each deformed radially inwardly relative to the tubular element to provide an upwardly facing abutment that can be overlain by its supporting portion of the spring seat member, the radially outer surface of the strip-like portion being engageable by said lug on its supporting portion to confine the spring seat member against edgewise displacement.

3. The keg closure of claim 2 wherein said tube member has a circumferential downwardly facing shoulder against which an upper end of said spring is engaged and has a portion between said shoulder and said valve element that has a uniform diameter along its length, further characterized by:

C. said tubular element further having circumferentially spaced, radially inwardly bent tabs above said strip-like portions which are opposite said portion of the tube member and slidably engageable therewith to cooperate with one another and said hole in the spring seat member for confining the tube member to substantially axial motion.

4. A keg closure for cooperation with a removable tapping coupler, comprising a relatively fixed substantially cylindrical element which is securable in a keg wall aperture and which defines a coaxial annular valve seat, a relatively fixed tubular element coaxially secured at a top end portion thereof to said cylindrical element and projecting downward therefrom, and an axially movable tube member coaxially received in said tubular element with substantial radial clearance and having an upper end at which there is a valve element, said tube member being substantially longer than said tubular element to have its lower end near the bottom of a keg in which the closure is installed and being biased upward for normal engagement of said valve element with said valve seat, said keg closure being characterized by:

A. a first portion of said tube member that is surrounded by said tubular element (1) being of substantially uniform diameter along its length, (2) being of larger diameter than a second portion of the tube member therebeneath, and (3) cooperating with said second portion to define a circumferential downwardly facing shoulder on the tube member;

B. a coiled spring surrounding said second portion of the tube member and having an upper end engaged against said circumferential shoulder and a lower end that reacts downward against said tubular element to bias the tube member upward; and C. said tubular element having integral, circumferentially spaced, radially inwardly bent tabs that slidingly engage said first portion of the tube member to confine the same to axial up and down motion.

5. The keg closure of claim 4, further characterized by:

D. said tubular element having near its bottom end a plurality of integral, circumferentially spaced and circumferentially elongated strip-like portions, each offset radially inwardly relative to its adjacent portions of the tubular element to define an upwardly facing abutment; and E. a substantially flat spring seat member having (1) a top surface against which said bottom end of the spring is engaged, (2) a central hole in which the tube member is received with a sliding fit, (3) circumferentially spaced edgewise projecting supporting portions which overlie said abutments in one position of edgewise rotation of the spring seat member and which define between them recesses that enable the spring seat member to pass said strip-like portions as it is axially upwardly inserted into said tubular element in another position of edgewise rotation, and (4) an integral downwardly projecting lug on each of said supporting portions for normally engaging the radially outer surface of its adjacent strip-like portion to cooperate therewith in confining the spring seat member against edgewise displacement.

6. A keg closure for cooperation with a removable tapping coupler, comprising a relatively fixed cylindrical element which is securable in a keg wall aperture and which defines a coaxial annular valve seat, an elongated axially movable tube member having at an upper end thereof an annular valve element cooperable with said valve seat, and a tubular element coaxially fixed to said cylindrical element and surrounding said movable tube member with substantial radial clearance, said tubular element being substantially shorter than said tube member and supporting a lower end of a coiled compression spring which surrounds the tube member and reacts upwardly against it to bias said valve element towards engagement with said valve seat, said keg closure being characterized by:

A. said cylindrical element having a coaxial downwardly projecting circumferential wall portion which surrounds an upper portion of said tubular element and in which there is a radially inwardly opening circumferential groove;

B. said tubular element having in its said upper portion a circumferential radially outward deformation which is received in said groove to provide a rigid connection between the tubular element and the cylindrical element;

C. said tube member having a portion downwardly adjacent to said valve element and above said spring that has a substantially uniform outside diameter along its length; and D. said tubular element having integral radially inwardly bent tabs at circumferentially spaced locations therearound, for sliding engagement with said portion of said tube member to confine it to substantially axial motion.

7. The keg closure of claim 6 wherein said cylindrical element is receivable in a keg bushing which is fixed in said keg wall aperture and which has an upwardly extending annular side wall with an internally threaded upper portion that has a larger inside diameter than the lower portion thereof and which has a radially inwardly projecting annular flange at the bottom of said side wall, and wherein said cylindrical element has a concentric upwardly opening well therein and has coupler lugs projecting radially into said well from its top portion to provide for attachment of a coupler unit thereto, further characterized by:

E. a resilient sealing ring closely surrounding said tubular element and underlying said circumferential wall portion of the cylindrical element to be axially compressed between the latter and said annular flange, for sealing the connection between the cylindrical element and said tubular element as well as providing a seal between said cylindrical element and said keg bushing;

F. an externally threaded annular collar receivable in said upper portion of said side wall in surrounding relation to an upper portion of said cylindrical element, said collar having an annular radially inwardly projecting flange at its top for overlying the top of the cylindrical element to confine the same in compressive relation to said sealing ring and to reinforce said coupler lugs against upward deformation.

8. The keg closure of claim 7, further characterized by:

G. said cylindrical element having at least one radially outwardly projecting lug engageable in a radially inwardly opening vertically extending groove in said lower portion of said side wall to confine the cylindrical element against rotation.

9. The keg closure of claim 6, further characterized by:

C. said tubular element having near a bottom end thereof circumferentially spaced radially inwardly offset abutment portions which provide coplanar upwardly facing abutments; and D. a substantially flat spring seat member having (1) an upper surface against which said lower end of said spring engages, (2) a central hole through which said tube member extends, (3) edgewise outwardly projecting supporting portions which can rest on said abutments in one position of edgewise rotation of the spring seat member and which define between them recesses that enable said spring seat member to pass said abutment portions as it is moved axially into and out of the tubular element in another position of its edgewise rotation, and (4) downwardly turned lugs on said supporting portions engageable with said abutment portions in said one position of rotation of the spring seat member to confine the same against edgewise displacement.

* * * * *